US005733699A

United States Patent [19]

Asanae et al.

[11] Patent Number: 5,733,699

[45] Date of Patent: Mar. 31, 1998

[54] DEVELOPER FOR DEVELOPING ELECTROSTATIC LATENT IMAGE

[75] Inventors: Masumi Asanae; Akihiko Funakawa; Tsutomu Saitou, all of Kumagaya, Japan

[73] Assignee: Hitachi Metals, Ltd., Tokyo, Japan

[21] Appl. No.: 745,802

[22] Filed: Nov. 8, 1996

Related U.S. Application Data

[63] Continuation of Ser. No. 526,925, Sep. 8, 1995, abandoned, which is a continuation of Ser. No. 92,619, Jul. 16, 1993, abandoned.

[30] Foreign Application Priority Data

Jul. 17, 1992 [JP] Japan ..... 4-190644

[51] Int. Cl.$^6$ ..... G03G 9/083; G03G 9/107

[52] U.S. Cl. ..... 430/106.6; 430/108; 430/137

[58] Field of Search ..... 430/106.6, 108, 430/137

[56] References Cited

U.S. PATENT DOCUMENTS

| | | | |
|---|---|---|---|
| 4,309,498 | 1/1982 | Yamashita et al. | 430/100 |
| 4,433,042 | 2/1984 | Kawanishi et al. | 430/126 |
| 4,517,274 | 5/1985 | Honda et al. | 430/122 |
| 4,526,851 | 7/1985 | Boughton et al. | 430/106.6 |
| 4,640,880 | 2/1987 | Kawanishi et al. | 430/106.6 |
| 4,920,023 | 4/1990 | Koch et al. | 430/108 X |
| 5,171,653 | 12/1992 | Jugle et al. | 430/108 |
| 5,256,513 | 10/1993 | Kawamura et al. | 430/106.6 |
| 5,260,159 | 11/1993 | Ohtani et al. | 430/106.6 |
| 5,354,638 | 10/1994 | Harada | 430/106.6 |
| 5,360,690 | 11/1994 | Nakano et al. | 430/106.6 X |
| 5,360,691 | 11/1994 | Koizumi et al. | 430/106.6 X |
| 5,391,451 | 2/1995 | Yoshie et al. | 430/106.6 |

FOREIGN PATENT DOCUMENTS

| | | | |
|---|---|---|---|
| 0492665 | 7/1992 | European Pat. Off. | 430/106.6 |
| 372372 | 3/1991 | Japan | 430/108 |
| 5173372 | 7/1993 | Japan | 430/108 |

OTHER PUBLICATIONS

English Translation of JP-5-173,372, Usami.

*Primary Examiner*—George F. Lesmes
*Assistant Examiner*—Bernard P. Codd
*Attorney, Agent, or Firm*—Finnegan, Henderson, Farabow, Garrett & Dunner, L.L.P.

[57] ABSTRACT

A developer for developing an electrostatic latent image is disclosed. It is obtained by mixing a chargeable magnetic toner mainly composed of a binder resin and magnetic powder, which toner has a volume resistivity of $10^{13}$ Ω·cm or greater, with a magnetic carrier having a volume resistivity of 10 Ω·cm or greater and less than $10^6$ Ω·cm at a weight ratio of between 10:90–90:10. A method of forming an image is also disclosed. An electrostatic latent image is formed on an image carrier. A magnetic brush formed of the developer slides against the surface of the image carrier. The visualized toner image is transferred to a recording medium. The previously-applied toner remaining on the surface of the image carrier is removed after transferring is completed and an electrostatic latent image is visualized when the magnetic brush slides against the surface of the image carrier.

1 Claim, 1 Drawing Sheet

DEVELOPER FOR DEVELOPING ELECTROSTATIC LATENT IMAGE

This application is a continuation of application Ser. No. 08/526,925,filed Sep. 8, 1995, now abandoned which is a continuation of application Ser. No. 08/092,619, filed Jul. 16, 1993, now abandoned.

BACKGROUND OF THE INVENTION

1. Field of the Invention

The present invention relates to a developer for developing an electrostatic latent image used for an electrophotographic printer, a facsimile, and the like, and to a method of forming an image using the same. More particularly, the present invention relates to a developer for developing an electrostatic latent image obtained by mixing a magnetic toner with a magnetic carrier, and a method of forming an image in which magnetic brushes comprise such a developer, thereby recovering the toner remaining on the surface of an image carrier and visualizing an electrostatic latent image.

2. Description of the Related Art

Conventionally, in a printer, a facsimile, or the like employing an electrophotographic process, a toner image is generally visualized by the following process. An electrostatic latent image corresponding to the information is formed on a cylindrically shaped photosensitive drum. A magnetic developer is attracted and fed by a developing roll containing a permanent magnet arranged opposite to the photosensitive drum. A magnetic brush arranged in the developing region slides against the surface of the photosensitive drum for forming an electrostatic latent image so as to visualize the toner image. Such a visualized toner image is transferred to a recording sheet, and then, fixed by heating.

A two-component developer obtained by mixing a magnetic carrier with a non-magnetic toner is generally used for developing an image by a magnetic brush as described above in an ordinary copying machine. However, the use of such a two-component developer for an electrophotographic printer, or the like, increases the number of members of the device such as a sensor for detecting a toner concentration density sensor and others, thus inhibiting the printer from being downsized. Therefore, a one-component developer composed of a magnetic toner or a magnetic developer obtained by mixing a magnetic toner with a magnetic carrier is often utilized.

The use of such a conventional magnetic developer enables downsizing of a printer and the like to some extent, but such downsizing is restricted. More specifically, a slight amount of toner remains on the photosensitive drum, that is, on the image carrier, even after the toner image is transferred to a recording sheet, and consequently, a cleaning device for removing this remaining toner is usually arranged. Therefore, a space for the cleaning device around the photosensitive drum must be provided, thus preventing a printer, or the like, from being compact-sized.

The following method for overall downsizing of a device is also available. The foregoing cleaning device is omitted, but a so-called developer cleaner is arranged in the region in which a photosensitive drum and a developing roll face each other so as to recover the toner remaining on the photosensitive drum and to visualize an electrostatic latent image. However, in such a method, when a single image development is performed per one rotation of the photosensitive drum, the toner remaining on the photosensitive drum after the toner image is transferred to a recording sheet may not be recovered in a developer cleaning section but may adhere to the previous electrostatic latent image forming section even after the development.

Such insufficient recoverability of the remaining toner causes extreme deterioration in the quality of the obtained image. In order to overcome such a problem, the following method is available for performing a single image development per two rotations of the photosensitive drum, thereby completely recovering the remaining toner. However, such a method has a problem in that the speed of forming an image is inevitably lowered, and thus, it is incompatible with the demand for accelerating the treatment of information.

SUMMARY OF THE INVENTION

Accordingly, an object of the present invention is to provide a developer for developing an electrostatic latent image and a method of forming an image using such a developer in which the foregoing problems inherent in the prior art can be solved and in which the toner remaining on the surface of an image carrier can be totally recovered, thus, enabling the overall downsizing of the device.

To achieve this object, according to a first aspect of the present invention, the present invention provides a developer for developing an electrostatic latent image obtained by mixing a chargeable magnetic toner mainly composed of a binder resin and magnetic powder and having a volume resistivity of not less than $10^{13}$ Ω·cm with a magnetic carrier having a volume resistivity of not less than 10 Ω·cm but less than $10^6$ Ω·cm at a weight ratio of between 10:90–90:10. The chargeable magnetic toner is capable of being charged in a particular (positive or negative) polarity due to the contact with a sleeve, a doctor blade or magnetic carrier etc.

In the present invention, the chargeable magnetic toner is required to have a volume resistivity of not less than $10^{13}$ Ω·cm in an electric field of D.C. 4000 V/cm so as to ensure transferring efficiency and to minimize the remaining toner transferred to the surface of an image carrier as much as possible.

Such volume resistivity was measured by taking some dozens of mg of a sample by the following process. The sample was put into an insulating cylinder which was obtained by reconstructing of a dial gauge, which cylinder was made of Teflon (Trade Mark) and which cylinder had an inner diameter of 3.05 mm (and having a cross sectional area of 0.073 $cm^2$). Then, a load of 0.1 kgf was applied to the sample. In this condition, the resistance of the chargeable magnetic toner and that of the magnetic carrier were measured in an electric field of D.C. 4000 V/cm and D.C. 200 V/cm, respectively, by utilizing an insulating resistance measurement device (4329A type) made by Yokogawa-Hewlett-Packard, Ltd. Then, the volume resistivity of the magnetic toner and that of the magnetic carrier were calculated.

Such a magnetic toner can be produced by mixing a binder resin, magnetic powder and a charge controlling agent at a suitable ratio, and then, by employing by a known process such as a pulverizing process and a spray dry process, or the like. A fluidity improving agent, such as silica fine powder, and/or a resistivity adjusting agent, such as carbon black, may be added to the inside and/or the surface of the toner particles.

A binder resin can be suitably selected according to the fixing process (for example, see U.S. Pat. No. 4,433,042). For instance, when the heating roll fixing process is employed, such binder resins include styrene-acrylic copolymer, styrene-butadiene copolymer, a polyester resin, an epoxy resin, and a resin mixture thereof.

Further, as the magnetic powder there can be used an alloy or a compound represented by ferrite and magnetite, containing ferromagnetic elements such as iron, cobalt and nickel, and the like. Such magnetic powder is preferably formed to have an average particle size of between 0.1–3 μm so as to be contained in a toner. The powder content in the toner is suitably between 10–70% by weight. Less than 10% by weight powder lowers the magnetic force of the toner, so that the toner will be apt to be scattered from the surface of a sleeve. On the other hand, more than 70% by weight powder lowers the volume resistivity of the toner because of the conductive characteristics inherent in the magnetic powder per se, which further causes a reduction in transferring efficiency and fixability. Thus, the magnetic powder content is preferably between 20–60% by weight.

The charge controlling agents include a known dye or pigment such as a nigrosine dye having positive frictional electrification characteristics or a nigrosine dye modified by a higher fatty acid, an azo dye including a metal (Cr) and having negative triboelectric charging characteristics, and the like. The content of the charge controlling agent is determined depending on the amount of triboelectric charge of the toner, and between 1–10% by weight is generally preferable.

In the present invention, the magnetic carrier having a volume resistivity of less than 10 Ω·cm is not preferable because a resultant toner is apt to adhere to the surface of the image carrier. On the other hand, the magnetic carrier having a volume resistivity of not less than $10^6$ Ω·cm is also undesirable because it lowers developing performance and recoverability of the toner remaining on the surface of the image carrier. Such volume resistivity can be effectively adjusted by such means as coating the surface of the carrier particles with a resin containing conductive particles, such as carbon black and metal powder, or as adding conductive particles to the surface of the carrier particles coated with a resin, the latter means being particularly effective.

As a material used for the magnetic carrier there are used metal powder such as iron powder, or the like, and oxide powders such as magnetite, ferrite, or the like. The magnetic carriers there can be used a ferrite carrier or the like. The ferrite carrier is a sintered particle of a suitable metal oxide and a trivalent iron oxide, and more specifically, Ba-Ni ferrite, Mn-Zn ferrite, Ni-Zn ferrite, Li-Zn ferrite, Cu-Zn ferrite, Cu-Zn-Mg ferrite, Mg-Zn ferrite and the like. Such a ferrite carrier can be produced by the following process. Raw materials mixed at a suitable ratio are calcined for 0.5–3 hours and pulverized into particles having an average particle size of 2.0 μm or smaller followed by granulated into particles having a predetermined size. Subsequently, the resultant particles are sintered for 3–5 hours at a temperature of between 1250°–1350° C., followed by being ground and classified.

A magnetic carrier having a smaller particle size makes the developer adhere to the surface of an image carrier easily, whereas the magnetic carrier having a greater particle size makes an image rough. Thus, the average diameter is preferably between 20–150 μm.

The developer for developing an electrostatic latent image according to the present invention is a mixture of a chargeable magnetic toner and the magnetic carrier as has been discussed above. A mixture of less than 10% by weight of the chargeable magnetic toner, that is, more than 90% by weight of the magnetic carrier is apt to cause an undesirable adhesion of the developer to the image carrier. On the other hand, a mixture of less than 10% by weight of the magnetic carrier is also likely to cause undesirable toner-scattering and an increase in the spent toner, thus shortening the life of the magnetic carrier.

To achieve the foregoing object, according to a second aspect of the present invention, the present invention also provides a method of forming an image, comprising the steps of: forming an electrostatic latent image on an image carrier; sliding against the surface of the image carrier by a magnetic brush comprising the developer as stated above; transferring the visualized toner image to a recording medium; and removing the previously-applied toner remaining on the surface of the image carrier after transferring is completed and visualizing an electrostatic latent image both of which removing and visualizing are effected together at the time when the magnetic brush slides against the surface of the image carrier.

The method of feeding the developer in the image forming method stated above is not specifically restricted, but at least, a method of rotating the sleeve is desirable in order to prevent the magnetic carrier from agglomerating magnetically. In addition to a method of rotating only the sleeve, a method of rotating both the sleeve and permanent magnet in the same direction (for example, see U.S. Pat. No. 4,309,498) or a method of rotating them in reversed directions each other may be employed.

The developing gap (a gap between the image carrier and the sleeve at the developing section) is required to be 1.0 mm or less in order to guarantee the contact width between magnetic brushes and the image carrier and to ensure the complete recoverability of the remaining toner; and it is also required to be 0.2 mm or greater so that the magnetic brushes can contact the image carrier lightly (softly), and more preferably between 0.3–0.6 mm. The doctor gap is determined in accordance with the developing gap.

According to the foregoing construction, the removability and recoverability of the remaining toner by a magnetic brush in the region in which developer cleaning is performed can be improved, and even in an image forming method without a cleaning process for cleaning the surface of the image carrier prior to forming an electrostatic latent image, the remaining toner present in the section for forming an electrostatic latent image can be totally recovered. Thus, a clear and high quality image can be obtained. The developer for developing an electrostatic latent image according to the present invention is applicable to a method of forming an image in which an image carrier can be cleaned prior to forming an image.

DESCRIPTION OF THE PREFERRED EMBODIMENTS

Styrene-acrylic emulsion containing 5% by weight of carbon black (MA600 made by Mitsubishi Kasei) was applied to the surface of a ferrite carrier (KBN-100 made by Hitachi Metals Ltd., having a particle size of 37–105 μm and a volume resistivity of $9\times10^8$ Ω·cm). 1% by weight of carbon black was further adhered to the resultant surface of the ferrite carrier coated with the emulsion. Thus, a coated ferrite carrier having a volume resistivity of $3\times10^4$ Ω·cm was obtained.

Then, a chargeable magnetic toner was prepared according to the following material composition.

| | (parts by weight) |
|---|---|
| Styrene-n butyl methacrylate (Mw = 21 × 104, Mn = 1.6 × $10^4$) | 50 |
| Magnetite (EPT500 made by Toda Kogyo Corporation) | 45 |
| Polypropylene (viscohl 550P made by Sanyo Chemical Industries, Ltd.) | 3 |
| Charge controlling agent (bontron E-81 made by Orient Chemical Industries, Ltd.) | 2 |

The materials having the above composition were kneaded for 30 minutes by a kneader having a heating roller. After the resultant materials were cooled and solidified, they were pulverized and classified into a magnetic toner having an average particle size of 11 μm. The volume resistivity of the magnetic toner was $3\times10^{14}$ Ω·cm.

Figure 1:
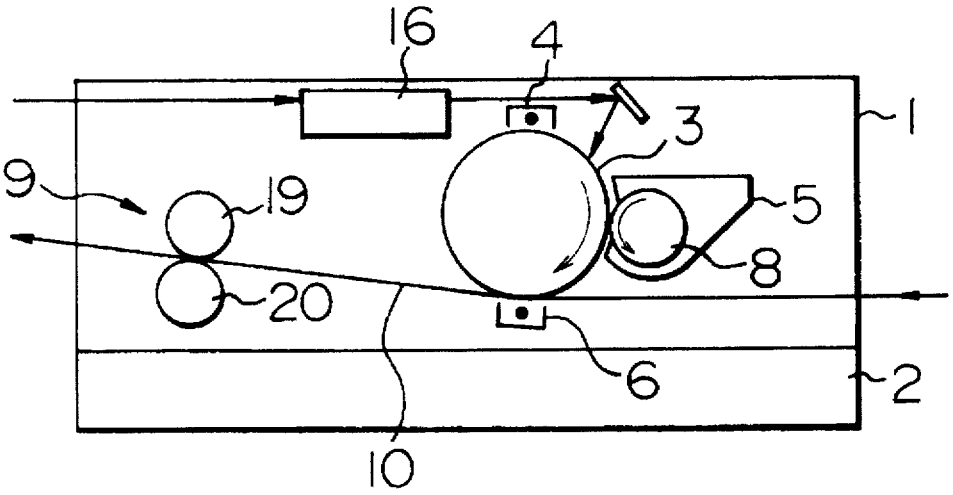
FIG. 1 shows the construction of an essential portion of image forming means in an embodiment according to the present invention.

FIG. 1 shows the construction of an essential portion of an example of image forming means in the embodiment of the present invention. Referring to FIG. 1, an image forming unit 1 accommodates the following components and is integrally arranged on a control unit 2. A cylindrically-formed photosensitive drum 3 has a photosensitive layer (not shown) comprising zinc oxide or an organic semiconductor on the peripheral surface and is arranged in the image forming unit 1 so as to rotate clockwise as indicated by the arrow in FIG. 1. A charger 4, a developer cleaner 5 formed as described hereinafter and a transfer device 6 are disposed in the vicinity of the outer periphery of the photosensitive drum 3. A magnet roll 8 is disposed rotatably in the developer cleaner 5 and formed so as to abut against the photosensitive drum 3.

A fuser generally denoted by 9 is disposed downstream of a route of a recording sheet 10 in the image forming unit 1 and constructed such that a heating roll 19 and a pressure roll 20 are rotatably brought into contact to each other by pressure. These two rollers 19 and 20 are each formed to have an outer diameter of 20 mm and brought into contact with each other at a linear pressure of 0.5 kgf/cm. The heating roll 19 is obtained as follows. A heating element composed of electrically resistant materials is arranged around the outer periphery of a core composed of aluminium, or the like, and the resultant surface is coated with a layer having release property and a thickness of approximately 10 μm which is composed of PTFE, or the like. On the other hand, the pressure roll 20 is obtained by coating the outer periphery of a core composed of a material similar to that of the heating roll 19 with an external layer composed of silicon rubber, or the like.

According to the above-mentioned construction, the respective components in the image forming unit 1 are engaged into a driving state or an operating state by the control unit 2 so as to input an electric signal corresponding to the information or an image. Then, the surface of the photosensitive drum 3 is charged uniformly by the charger 4 and the resultant charged surface is irradiated with a laser beam by the electric signal so as to form an electrostatic latent image. The resultant electrostatic latent image is visualized (developed) as a toner image by a magnetic developer which is attracted and fed by the magnet roll 8 in the developer cleaner 5, and is transferred by the transfer device 6 on a recording sheet (not shown) which is shifted in the recording sheet route 10. The magnetic toner remaining on the photosensitive drum 3 after transferring is removed from the drum 3 simultaneously when the electrostatic latent image is visualized in the developer cleaner 5.

Subsequently, the recording sheet supporting the toner image is fed to the fuser 9 in which heat from the heating roll 19 is applied to the toner image on the recording sheet and a binder resin forming the magnetic toner is melted, thus fixing the image.

Figure 2:
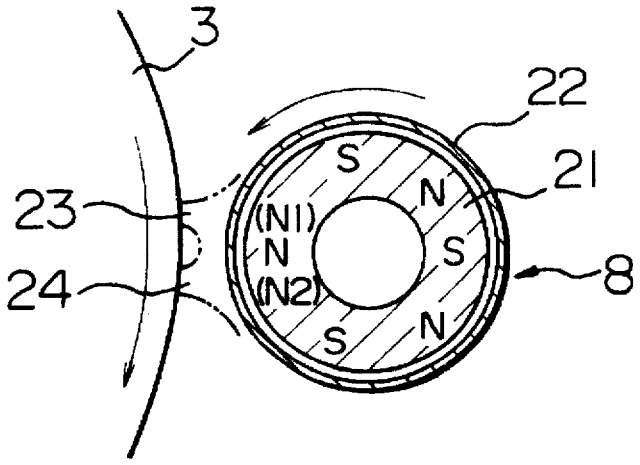
FIG. 2 is an enlarged cross sectional view of an essential portion showing a magnet roll 8 in FIG. 1.

FIG. 2 is an enlarged cross sectional view of an essential portion showing the magnet roll 8 in FIG. 1. Referring to FIG. 2, the magnet roll 8 is formed such that a permanent magnet 21 and a sleeve 22 are arranged coaxially. The permanent magnet 21 is integrally formed in a cylinder of a sintered powder magnet material, such as hard ferrite, or a mixture of ferromagnetic magnet material powder and a binder. The sleeve 22 is hollow-cylindrically formed of a non-magnetic material, such as an aluminium alloy or stainless steel.

A plurality of magnetic poles extending axially is arranged on the outer surface of the permanent magnet 21 so that a specific magnetic pole (for example, N pole) faces opposite to the photosensitive drum 3. Unlike the other poles, such a specific magnetic pole may comprise adjacent N1 and N2 poles as indicated by brackets in FIG. 2 so as to produce two peaks. The sleeve 22 is constructed such that it rotates counterclockwise around the permanent magnet 21, thereby attracting the magnetic developer (not shown) and feeding it to the photosensitive drum 3.

According to the above-mentioned construction, magnetic brushes 23 and 24 comprising a magnetic developer which is attracted by the magnetic poles $N_1$ and $N_2$ are formed in the region in which the magnet roll 8 and the photosensitive drum 3 face each other, and slide against the surface of the photosensitive drum 3. Thus, the magnetic toner remaining on the photosensitive drum 3 is removed and recovered by the magnetic brush 23 after the toner image passes through the transfer device 6 shown in FIG. 1. An electrostatic latent image on the photosensitive drum 3 is developed by the magnetic brush 24. That is, the magnetic toner in the magnetic developer adheres to an electrostatic latent image so as to form a developed toner image.

A description will be now given of image forming performed in the image forming unit 1 illustrated in FIG. 1 by utilizing a developer obtained by mixing the ferrite carrier with the chargeable magnetic toner as has been discussed above. First, the photosensitive drum 3 was uniformly charged at −550V with the charger 4 and rotated clockwise as indicated by the arrow in FIG. 1 at a surface speed of 60 mm/second.

The magnet roll 8 forming the developer cleaner 5 had a sleeve formed of SUS304, the outer diameter of which was 20 mm, and was rotated at 150 r.p.m. counterclockwise as indicated by the arrow in FIG. 1. The permanent magnet 21 shown in FIG. 2 comprised 6 poles for magnetization and the magnetic flux density on the surface of the sleeve 22 was determined to be 700G. A biasing voltage of −400V was applied to the sleeve 22. A doctor gap and a developing gap were determined to be 0.35 mm and 0.3 mm, respectively. After transferring, heating roll fixing was performed at a temperature of 180° C. and a linear pressure of 1 kgf/cm.

In the image forming stated above, when the magnetic developer comprising the ferrite carrier (having a volume resistivity of $9\times10^8$ Ω·cm) was used, the toner recoverability achieved by the developer cleaner 5 was not sufficient to recover the magnetic toner remaining on the photosensitive drum 3 after transferring, but it remained and adhered to an electrostatic latent image formed in the following process. This is because a so-called memory effect occurred, and thus, a deterioration in the quality of the image was noticeable. On the other hand, when the magnetic developer of the present invention comprising the coated ferrite carrier (having a volume resistivity of $3\times10^4$ Ω·cm) was used, the toner recoverability achieved by the developer cleaner 5 was sufficient to prevent the memory effect from occurring, and thus, a high quality image was able to be formed.

According to the construction and operation, the present invention offers the following advantages.

A magnetic carrier having a smaller volume resistivity than that of conventional carriers is used for a magnetic developer. Thus, the removability and recoverability of the remaining toner by a magnetic brush in the region in which the developer cleaning is performed can be improved, and even in image-forming without cleaning means for cleaning the surface of an image carrier or without a cleaning process, the remaining toner can be totally recovered. Thus, a clear and high quality image can be obtained.

What is claimed is:

1. A developer for developing an electrostatic latent image, said developer being a mixture of chargeable magnetic toner particles and magnetic carrier particles at a mixing weight ratio of said magnetic carrier to said magnetic toner between 10:90–90:10, wherein said magnetic toner particles are comprised of a binder resin and magnetic powder and have a volume resistivity of not less than $10^{13}$ Ω·cm; and said magnetic carrier particles are formed by applying to a core of iron, magnetite, or ferrite a resin coating layer having particles of carbon black dispersed therein and subsequently adhering particles of carbon black to the resultant surface of said resin coating layer, and have a volume resistivity of not less than 10 Ω·cm but less than $10^6$ Ω·cm.

* * * * *